US006048168A

United States Patent [19]

Sabini

[11] Patent Number: 6,048,168

[45] Date of Patent: Apr. 11, 2000

[54] LUBRICATED CERAMIC/HYBRID ANTI-FRICTION BEARING CENTRIFUGAL PUMP

[75] Inventor: Eugene P. Sabini, Skaneateles, N.Y.

[73] Assignee: Goulds Pumps, Incorporated, Seneca Falls, N.Y.

[21] Appl. No.: 09/025,909

[22] Filed: Feb. 19, 1998

[51] Int. Cl.[7] ..... F01D 25/22

[52] U.S. Cl. ..... 415/111; 415/102; 415/104; 415/98; 415/180; 415/214.1; 415/229; 415/230

[58] Field of Search ..... 415/111, 112, 415/214.1, 230, 102, 104, 229, 180, 98; 384/907.1, 492, 476

[56] References Cited

U.S. PATENT DOCUMENTS 3,457,869 7/1969 Janetz ..... 415/214.1
4,799,810 1/1989 Gilbert ..... 384/606
5,228,786 7/1993 Tanimoto et al. ..... 384/492
5,302,091 4/1994 Horiuchi ..... 417/420

*Primary Examiner*—Edward K. Look
*Assistant Examiner*—Ninh Nguyen
*Attorney, Agent, or Firm*—Brezina & Ehrlich

[57] ABSTRACT

A pump assembly for conventionally driven centrifugal pumps having a rolling element comprised of product lubricated ceramic or hybrid anti-friction bearings. The ceramic bearings are comprised of ceramic balls and ceramic races, whereas the hybrid bearings are comprised of ceramic balls with races made of another material. The ability of these bearings to perform well with poor lubrication allows the fluid that is being pumped to be used to lubricate and cool the bearings. An alternate embodiment comprises a double suction pump with the same durability and cost saving advantages.

13 Claims, 1 Drawing Sheet

LUBRICATED CERAMIC/HYBRID ANTI-FRICTION BEARING CENTRIFUGAL PUMP

BACKGROUND OF THE INVENTION

The present invention relates generally to a centrifugal pump, and more particularly to the design of the pump using product lubricated ceramic/hybrid anti-friction ball bearings.

DESCRIPTION OF RELATED ART

Bearing manufacturers recommend the use of ceramic and hybrid bearings in the manufacture of centrifugal pumps as a means of extending the lives of the pumps; ceramic bearings are comprised of ceramic balls and ceramic races, whereas hybrid bearings are comprised of ceramic balls with races made of another material. Centrifugal pump manufacturers normally do not use these bearings because of their high costs, which are typically 5 to 10 times the cost of traditional designs. Other industries, such as the machine tool manufacturers, have been using ceramic and hybrid bearings for the past 7 to 10 years. The centrifugal pump industry will not tolerate the high cost associated with using these bearings.

Ceramic and hybrid bearings are superior to standard pump bearings because of their ability to operate successfully with increased longevity compared to standard pump bearings, even when the lubricants become contaminated with particles or with water or other fluids, resulting in a loss of lubricity. Ceramic and hybrid bearings are conducive to product lubrication. These ceramic and hybrid bearings can typically run without maintenance for 2 to 3 weeks. Under these circumstances the user considers these bearings to be very cost effective.

Product lubrication is disclosed in the specification of U.S. Pat. No. 5,385,454, for a bearing device for a canned motor. Canned motor pumps are quite different from conventionally driven centrifugal pumps. For example, in the '454 patent, the bearings are housed in a cartridge type bearing device, whereas conventionally driven centrifugal pumps contain bearing housings built into the pump.

In the case of the magnetically driven centrifugal pump described in the specification of U.S. Pat. No. 5,302,091, a ceramic radial bearing and a ceramic thrust bearing in the form of a collar are disclosed as integral parts of the pump and product lubrication is disclosed as well. However, the '091 patent does not suggest conventionally driven centrifugal pumps nor does it suggest anti-friction bearings.

Traditional design philosophies of pumps must change in order to take advantage of the unique features these product lubricated ceramic/hybrid anti-friction bearings can offer. These features include limited dry running capability, the ability to be lubricated with low lubricity fluids, and the ability to withstand particle contamination. Today's limited vision is to use these bearings the same way standard pump bearings are used. Although this approach would lead to increased bearing and pump life, it does not address increased costs.

Accordingly, it is an object of the present invention to provide a centrifugal pump comprising product lubricated ceramic or hybrid anti-friction bearings to enable a longer lasting pump than pumps using standard bearings.

It is a further object of the present invention to provide such a product lubricated ceramic or hybrid anti-friction bearing centrifugal pump at a reduced manufacturing cost.

SUMMARY OF THE INVENTION

In accordance with these and other objects, the present invention provides a cost-effective centrifugal pump comprising product lubricated ceramic or hybrid anti-friction bearings with dry running capability in case the pump loses prime. In accordance with a preferred embodiment, the between bearing centrifugal pump comprises product lubricated full ceramic or hybrid anti-friction bearings in the stuffing box region of the pump.

The ceramic bearings are comprised of ceramic balls and ceramic races, whereas the hybrid bearings are comprised of ceramic balls with races made of another material. The ability of these bearings to perform well with poor lubrication allows the fluid that is being pumped to be used to lubricate and cool the bearings, which reduces the cost of producing and maintaining the pumps by eliminating unnecessary pump parts, thereby reducing the amount of material required to produce the pumps and eliminating the need for special lubrication.

Unnecessary pump parts that may be eliminated in the preferred embodiment, thereby reducing costs, include pump bearing housings. In addition, shorter overall shaft lengths and diameters may be obtained by shortening the bearing centerline distances by placing the bearings as close as possible to the cantilevered impeller while maintaining the same mechanical and rotordynamic properties. Material costs can be further reduced by reducing the size of the mechanical seal on the inboard end of the shaft, and in double suction pumps, the outboard mechanical seal may be eliminated. By maintaining optimal $L^3/D^4$ ratios, wherein L is the length of the shaft and D is the diameter of the shaft, less shaft deflection occurs, thereby increasing both mechanical seal and pump life.

BRIEF DESCRIPTION OF DRAWING

The present invention and the advantages thereof will become more apparent upon consideration of the following detailed description when taken in conjunction with the accompanying drawing.

DETAILED DESCRIPTION OF THE PREFERRED EMBODIMENTS OF THE INVENTION

Figure 1:
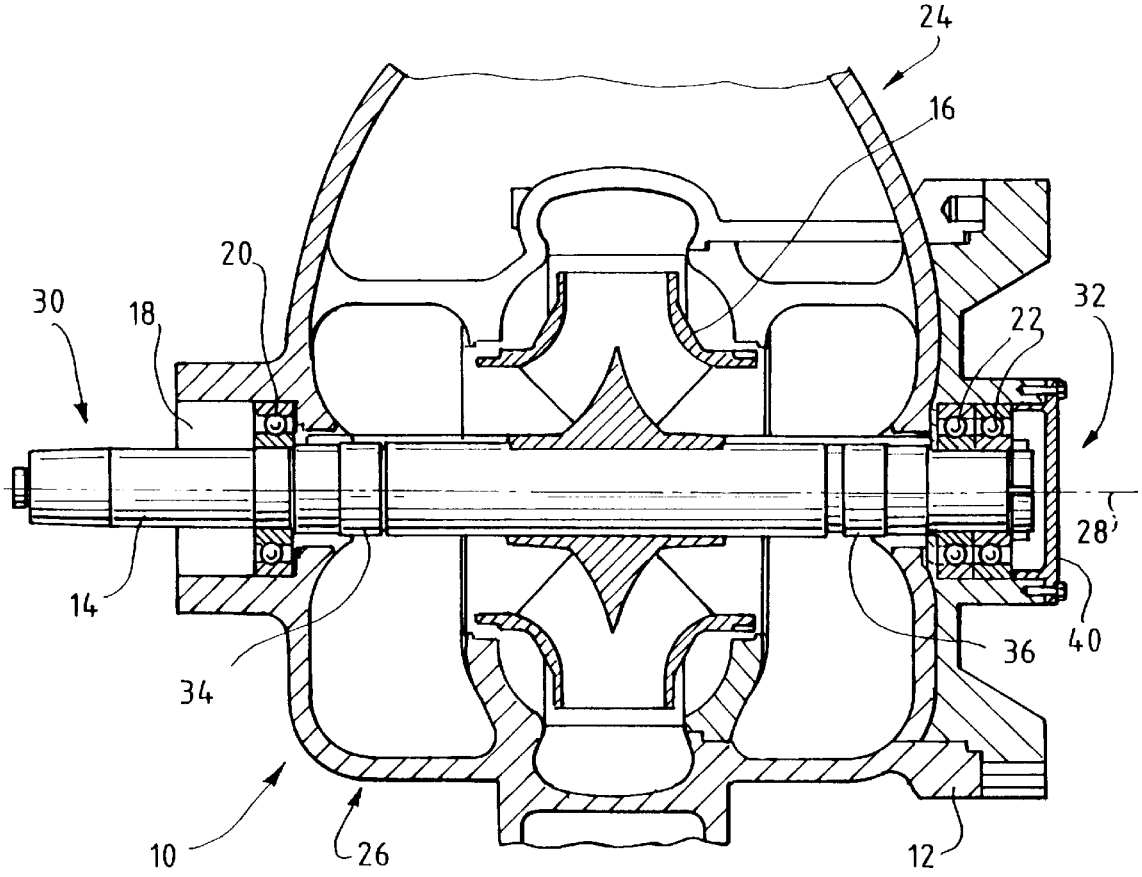
FIG. 1 is a cross-sectional view of a centrifugal pump assembly taken along its longitudinal axis having product lubricated ceramic/hybrid anti-friction bearings in accordance with a preferred embodiment of the invention.

A centrifugal pump assembly having product lubricated ceramic/hybrid anti-friction bearings in accordance with a preferred embodiment of the invention is illustrated in FIG. 1.

As illustrated in FIG. 1, the centrifugal pump 10 is comprised generally of a casing 12, a shaft 14, an impeller 16, and ball bearings 20 and 22. The pump 10 is divided into two halves, an upper half 24 and a lower half 26, which are bolted and doweled together to form the pump casing 12. The shaft 14, having an inboard end 30 and an outboard end 32, defines a longitudinal axis 28. The shaft 14 and the impeller 16 are interposed between and supported by the two halves 24 and 26 of the casing 12. The impeller 16 is cantilevered to the shaft 14. In operation, fluid is suctioned into the pump 10 by the rotating impeller 16.

The ball bearings 20 and 22 are located near the inboard end 30 and the outboard end 32 of the shaft. These bearings 20 and 22 may be either ceramic or hybrid. Ceramic bearings are comprised of ceramic balls and ceramic races, whereas hybrid bearings are comprised of ceramic balls with races made of another material. Ceramic/hybrid bearings are able to operate successfully with increased longevity compared to standard pump bearings, even when lubricants become contaminated with particles or with water or other fluids, resulting in a loss of lubricity. Ceramic and hybrid bearings are conducive to product lubrication; that is, the fluid being pumped may be used to lubricate the bearings 20 and 22. These ceramic/hybrid bearings 20 and 22 can typically run without maintenance for 2 to 3 weeks.

Product lubricated ceramic/hybrid radial bearings 20 are located in a seal chamber 18 near the inboard end 30 of the shaft 14 as close as possible to the impeller 16 without changing the mechanical and rotordynamic properties of conventional centrifugal pumps by employing the optimal $L^3/D^4$ ratio, wherein L is the length of the shaft 14 and D is the diameter of the shaft 14. An inboard mechanical seal 34, located circumferentially about the shaft 14 near the inboard end 30 within the seal chamber 18, prevents the pumped fluid from migrating outside its intended path. The inboard mechanical seal 34 is smaller than inboard mechanical seals on conventional centrifugal pumps because of the optimal $L^3/D^4$ ratio.

Product lubricated ceramic/hybrid thrust bearings 22 are located near the outboard end 32 of the shaft 14 as close as possible to the impeller 16 without changing the mechanical and rotordynamic properties of conventional centrifugal pumps, which is accomplished through use of the optimal $L^3/D^4$ ratio. An outboard mechanical seal 36, located circumferentially about the shaft 14 near the outboard end, prevents the pumped fluid from migrating outside its intended path. The outboard mechanical seal 36 is smaller than outboard mechanical seals on conventional centrifugal pumps because of the optimal $L^3/D^4$ ratio. A closure 40 is provided at the outboard end of the pump.

Through the use of the optimal $L^3/D^4$ ratio, cost saving is achieved through the reduction of material costs and less shaft 14 deflection occurs, thereby increasing the lives of the mechanical seals 34 and 36 and the life of the pump 10.

In an alternate embodiment, the pump 10 is a double suction pump wherein additional cost savings may be obtained by eliminating the outboard mechanical seal 36.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A pump assembly for a centrifugal, between bearing pump with dry running capability, driven by conventional means, comprising:

a) a casing having two halves;

b) a shaft having an inboard end and an outboard end;

c) an impeller cantilevered to the shaft and interposed between and supported by the two halves of the casing;

d) an inboard rolling element comprising anti-friction bearings having ceramic balls supporting said shaft at said inboard end, said anti-friction bearings of said inboard rolling element being lubricated by liquid being pumped and being disposed in a seal chamber open to liquid being pumped and providing an external seal for the pump;

e) an outboard rolling element comprising anti-friction bearings having ceramic balls supporting said shaft at said outboard end, said anti-friction bearings of said outboard rolling element being lubricated by liquid being pumped and being disposed at the outboard end of the shaft open to liquid being pumped; and f) a closure external to the outboard end of the shaft.

2. The pump assembly of claim 1 wherein the bearings have ceramic races.

3. The pump assembly of claim 1 wherein the bearings have metal races.

4. The pump assembly of claim 1 further comprising a mechanical seal on the inboard end of the shaft, disposed between the inboard rolling element and the impeller, permitting liquid being pumped to flow to and lubricate the anti-friction bearing of said inboard rolling element.

5. The pump assembly of claim 1 further comprising a mechanical seal on the outboard end of the shaft, disposed between the outboard rolling element and the impeller, permitting liquid being pumped to flow to and lubricate the anti-friction bearing of said outboard rolling element.

6. The pump assembly of claim 1 wherein the inboard rolling element comprises anti-friction radial bearings located near the inboard end of the shaft.

7. The pump assembly of claim 1 wherein the outboard rolling element comprises anti-friction thrust bearings located near the outboard end of the shaft.

8. A pump assembly for a double suction, between bearing pump with dry running capability, driven by conventional means, comprising:

a) a casing having two halves;

b) a shaft having an inboard end and an outboard end;

c) an impeller cantilevered to the shaft and interposed between and supported by the two halves of the casing;

d) an inboard rolling element comprising anti-friction bearings having ceramic balls supporting said shaft at said inboard end, said anti-friction bearings of said inboard rolling element being lubricated by liquid being pumped and being disposed in a seal chamber open to liquid being pumped and providing an external seal for the pump;

e) an outboard rolling element comprising anti-friction bearings having ceramic balls supporting said shaft at said outboard end, said anti-friction bearings of said outboard rolling element being lubricated by liquid being pumped and being disposed at the outboard end of the shaft open to liquid being pumped; and f) a closure external to the outboard end of the shaft.

9. The pump assembly of claim 8 wherein the bearings have ceramic races.

10. The pump assembly of claim 8 wherein the bearings have metal races.

11. The pump assembly of claim 8 further comprising a mechanical seal on the inboard end of the shaft, disposed between the inboard rolling element and the impeller, permitting liquid being pumped to flow to and lubricate the anti-friction bearing of said inboard rolling element.

12. The pump assembly of claim 8 wherein the inboard rolling element comprises anti-friction radial bearings located near the inboard end of the shaft.

13. The pump assembly of claim 8 wherein the outboard rolling element comprises anti-friction thrust bearings located near the outboard end of the shaft.

* * * * *